US009969166B2

(12) United States Patent
Suzuki

(10) Patent No.: US 9,969,166 B2
(45) **Date of Patent: *May 15, 2018**

(54) INKJET HEAD WITH A PLURALITY OF INTEGRATED NOZZLES

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Isao Suzuki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/242,803

(22) Filed: Aug. 22, 2016

(65) Prior Publication Data

US 2016/0355016 A1 Dec. 8, 2016

Related U.S. Application Data

(62) Division of application No. 14/548,602, filed on Nov. 20, 2014, now Pat. No. 9,446,591.

(30) Foreign Application Priority Data

Nov. 22, 2013 (JP) ..... 2013-242094

(51) Int. Cl.
*B41J 2/155* (2006.01)
*B41J 2/14* (2006.01)

(52) U.S. Cl.
CPC ..... *B41J 2/155* (2013.01); *B41J 2/1433* (2013.01); *B41J 2/14209* (2013.01); *B41J 2002/14475* (2013.01); *B41J 2202/12* (2013.01)

(58) Field of Classification Search
CPC .. B41J 2/1433; B41J 2/14209; B41J 2202/12; B41J 2002/14475; B41J 2/155
See application file for complete search history.

(56) References Cited

U.S. PATENT DOCUMENTS

2002/0180831 A1 12/2002 Okuda et al.
2005/0200647 A1* 9/2005 Sugahara ..... B41J 2/211 347/20

(Continued)

FOREIGN PATENT DOCUMENTS

JP 06-047914 2/1994
JP 2002-151499 5/2002

(Continued)

OTHER PUBLICATIONS

Non-Final Office Action for U.S. Appl. No. 14/548,602 dated Mar. 26, 2015.

(Continued)

*Primary Examiner* — Bradley Thies
(74) *Attorney, Agent, or Firm* — Amin, Turocy & Watson LLP

(57) ABSTRACT

An inkjet head comprises a pressure chamber; a nozzle plate including a first surface at the side of the pressure chamber, a second surface opposite to the first surface, a first nozzle formed into a frustum which penetrates the first surface and the second surface and the diameter of which decreases as it goes closer to the second surface, and a second nozzle formed into a frustum which is the same as the frustum of the first nozzle; and a driving element configured adjacent to the pressure chamber to eject droplets from the first nozzle and the second nozzle simultaneously; wherein the part of the first nozzle on the first surface is integrally connected to the part of the second nozzle on the first surface, and the part (Continued)

of the first nozzle on the second surface is separated from the part of the second nozzle on the second surface.

10 Claims, 9 Drawing Sheets

(56) References Cited

U.S. PATENT DOCUMENTS

| | | | | |
|---|---|---|---|---|
| 2007/0126788 | A1 | 6/2007 | Takahashi et al. | |
| 2009/0174735 | A1 | 7/2009 | Yamada | |
| 2012/0229571 | A1* | 9/2012 | Oosugi ..... | B41J 2/14233 347/47 |
| 2013/0002766 | A1 | 1/2013 | Koseki | |
| 2013/0187986 | A1 | 7/2013 | Koseki | |

FOREIGN PATENT DOCUMENTS

| | | | |
|---|---|---|---|
| JP | 2002-154199 | | 5/2002 |
| JP | 2003-080700 | | 3/2003 |
| JP | 2009-160807 | | 7/2009 |
| JP | 2009-226814 | | 10/2009 |
| JP | 2009-233879 | | 10/2009 |
| JP | 2009226814 | A * | 10/2009 |
| JP | 2009233879 | A * | 10/2009 |

OTHER PUBLICATIONS

Final Office Action for U.S. Appl. No. 14/548,602 dated Jul. 23, 2015.

Non-Final Office Action for U.S. Appl. No. 14/548,602 dated Nov. 20, 2015.

Final Office Action for U.S. Appl. No. 14/548,602 dated Mar. 23, 2016.

Extended European Search Report for European Patent Application No. 14194329.0-1701 dated Apr. 15, 2015, 8 pages.

Japanese Office Action for Japanese Patent Application No. 2013-242094 dated May 23, 2017.

Japanese Office Action for Japanese Patent Application No. 2016-161683 dated Feb. 6, 2018.

* cited by examiner

INKJET HEAD WITH A PLURALITY OF INTEGRATED NOZZLES

CROSS-REFERENCE TO RELATED APPLICATIONS

This application is a Division of application Ser. No. 14/548,602 filed Nov. 20, 2014, the entire contents of which are incorporated herein by reference.

This application is based upon and claims the benefit of priority from Japanese Patent Application No. 2013-242094, filed Nov. 22, 2013, the entire contents of which are incorporated herein by reference.

FIELD

Embodiments described herein relate generally to an inkjet head which can eject ink to carry out printing.

BACKGROUND

An inkjet head used in an inkjet printer is provided with a nozzle plate including nozzles, a pressure chamber connected with the nozzles and a piezoelectric vibrator for ejecting liquid from the nozzles. When pressure fluctuation occurs in the pressure chamber through the operation of the piezoelectric vibrator, droplets are ejected from the nozzles.

DETAILED DESCRIPTION

In accordance with one embodiment, an inkjet head comprises a pressure chamber; a nozzle plate configured to include a first surface at the side of the pressure chamber, a second surface opposite to the first surface, a first nozzle formed into a frustum which penetrates the first surface and the second surface and the diameter of which decreases as it goes closer to the second surface, and a second nozzle formed into a frustum which penetrates the first surface and the second surface and the diameter of which decreases as it goes closer to the second surface; and a driving element configured adjacent to the pressure chamber to eject droplets from the first nozzle and the second nozzle simultaneously; wherein the part of the first nozzle on the first surface is integrally connected to the part of the second nozzle on the first surface, and the part of the first nozzle on the second surface is separated from the part of the second nozzle on the second surface.

Hereinafter, a first embodiment of the inkjet head is described with reference to FIG. 1-FIG. 9. The inkjet head, arranged in a printing apparatus, can print characters, images and the like on a print target such as paper with liquid (ink) supplied from the printing apparatus. The liquid (ink) used in the inkjet head further contains functional ink having various functions used for a purpose other than forming an image, in addition to various kinds of ink used to form an image.

An inkjet head 11, arranged in an inkjet printer (printing apparatus), is connected with a tank (ink tank, liquid tank) arranged inside the inkjet printer through a tube and the like. The inkjet head 11 includes a head main body 12, a unit part 13 and a pair of circuit substrates 14.

The unit part 13 includes a manifold which forms one part of a path between the head main body 12 and the tank, and a member for connecting with the inkjet printer. The pair of circuit substrates 14 is arranged on the head main body 12, respectively.

Figure 1:
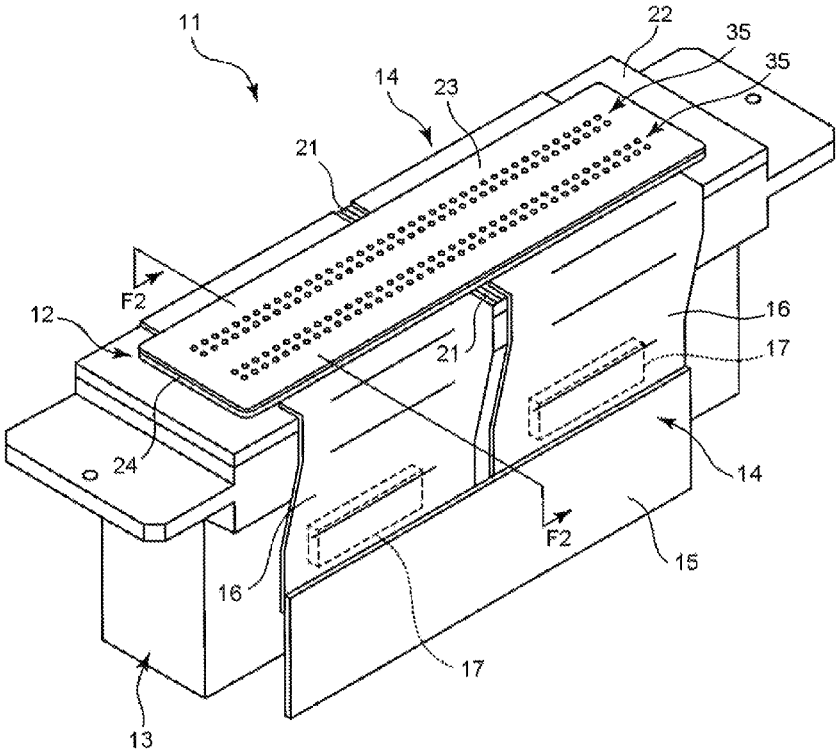
FIG. 1 is a perspective view illustrating an inkjet head according to a first embodiment.

As shown in FIG. 1, the pair of circuit substrates 14 includes a substrate main body 15 and a pair of film carrier packages (FOP 16), respectively. The substrate main body 15 is a rectangular printed wiring board. Various electronic components and connectors are arranged in the substrate main body 15. Further, the pair of FCPs 16 is mounted to the substrate main body 15, respectively.

The pair of FCPs 16 includes a flexible resin-made film in which a plurality of wiring is formed and ICs 17 connected with the plurality of wiring, respectively. The film is tape automated bonding (TAB). The IC 17 is a component for applying voltage to an electrode. The IC 17 is fixed onto the film through resin.

Figure 2:
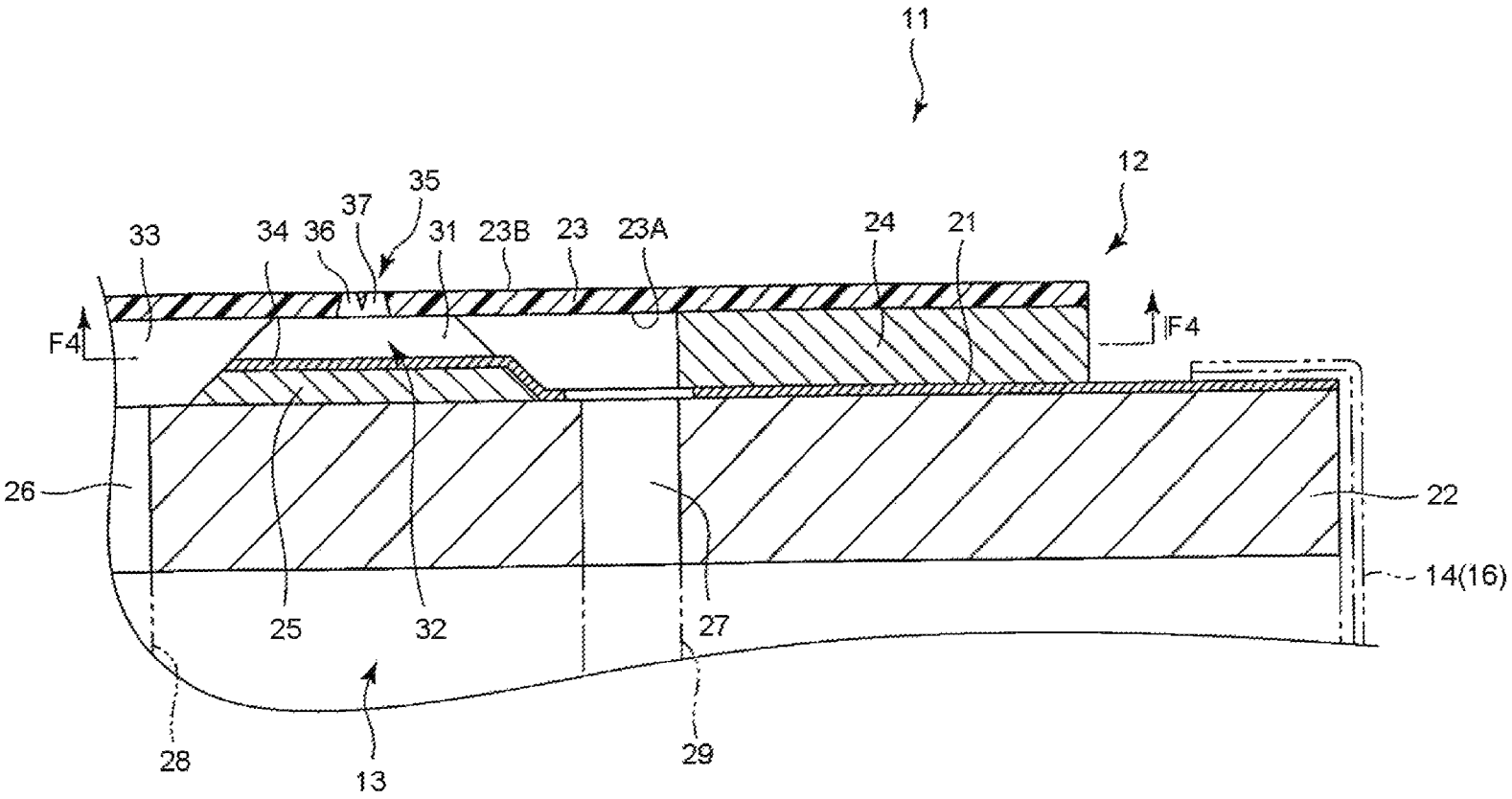
FIG. 2 is a cross-sectional view of the inkjet head shown in FIG. 1 taken along a line F2-F2.

As shown in FIG. 2, the end of the FCP 16 is connected with a wiring pattern 21 on a baseplate through thermocompression bonding with an anisotropic conductive film (ACF). The plurality of wiring of the FCP is electrically connected with the wiring pattern 21 through the ACF.

The head main body 12 is a device for ejecting droplets (ink drops) to the print target. The head main body 12 is mounted onto the unit part 13. As shown in FIG. 2, the head main body 12 includes a baseplate 22, a nozzle plate 23, a frame member 24, and blocks 25 on which a plurality of driving elements 31 are arranged.

Figure 3:
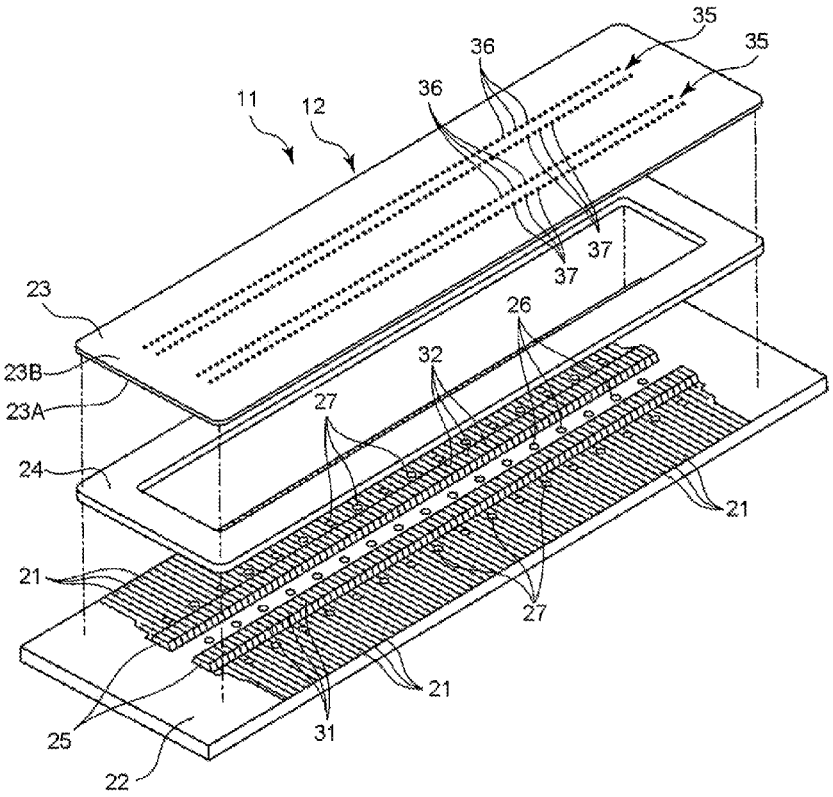
FIG. 3 is an exploded perspective view illustrating the inkjet head shown in FIG. 1.

As shown in FIG. 2 and FIG. 3, the baseplate 22 is, for example, a rectangular plate formed with ceramic such as alumina and the like. A plurality of supply holes 26 and a plurality of discharge holes 27 are arranged to penetrate the baseplate 22.

The supply holes 26 are arrayed at substantially central portion of the baseplate 22 in the longitudinal direction of the baseplate 22. The supply hole 26 is connected with an ink supply section 28 of the manifold of the unit part 13. The supply hole 26 is connected with the tank through the ink supply section 28.

The discharge holes 27 are arrayed at two sides of the baseplate 22 in the longitudinal direction with the supply holes 26 nipped therebetween. The discharge hole 27 is connected with an ink discharge section 29 of the manifold of the unit part 13. The discharge hole 27 is connected with the tank through the ink discharge section 29.

The frame member 24 is a rectangular frame formed by, for example, a nickel alloy and the like. The frame member 24 is arranged between the baseplate 22 and the nozzle plate 23. The frame member 24 is adhered to amounting surface of the baseplate 22 and the nozzle plate 23, respectively.

The driving elements 31 (the blocks 25 on which a plurality of driving elements are arranged) are formed by two plate-shaped piezoelectric bodies which are formed by, for example, lead zirconate titanate (PZT). The two piezoelectric bodies are bonded together in such a manner that the directions of polarization thereof are opposite in the thickness direction.

The block 25 on which the plurality of driving elements 31 are arranged is adhered to the mounting surface of the baseplate 22. As shown in FIG. 2, the block 25 is formed in a shape of which the cross-section is trapezoidal. The top of the driving element 31 is adhered to the nozzle plate 23.

As shown in FIG. 3, a plurality of grooves is formed on the block 25. The grooves extend in a direction crossing the longitudinal direction (longitudinal direction of the inkjet head 11) of the block 25, respectively. The plate-shaped driving elements 31 are separated from each other by the grooves. The areas in the grooves serve as pressure chambers 32 which face later described first nozzles 36 and second nozzles 37. The driving elements 31 can eject droplets from the later described first nozzle 36 and the second nozzle 37 simultaneously. As shown in FIG. 2, the nozzle plate 23, the parts of the baseplate 22 nearby the supply holes 26 and the slope part of the block 25 constitute a common liquid chamber 33 for supplying liquid (ink) to each pressure chamber 32. The common liquid chamber 33 is connected to each pressure chamber 32.

Figure 4:
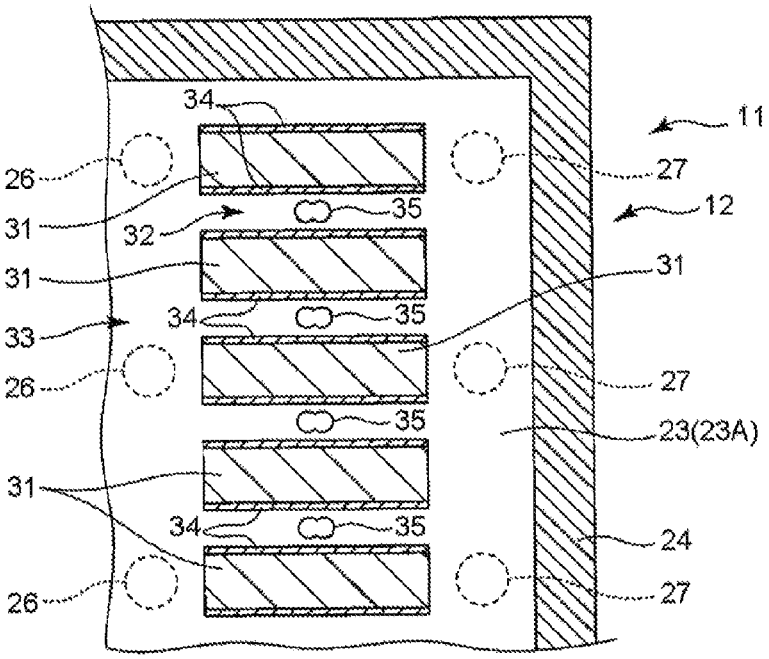
FIG. 4 is a cross-sectional view of the inkjet head shown in FIG. 2 taken along a line F4-F4.

As shown in FIG. 4, electrodes 34 are arranged at both sides of the driving element 31. The electrodes 34 cover the bottom of the grooves (pressure chambers 32) and the lateral sides of the driving elements 31. The electrodes 34 are formed by, for example, laser patterning a nickel thin film.

As shown in FIG. 3, a plurality of wiring patterns 21 is arranged on the mounting surface of the baseplate 22 to extend in a direction crossing the longitudinal direction of the baseplate 22 from the plurality of driving elements 31. The wiring pattern 21 is formed by, for example, laser patterning the nickel thin film formed on the baseplate 22.

As shown in FIG. 3, the nozzle plate 23, which is in a substantially rectangular shape, is formed by, for example, a polyimide film. The nozzle plate 23 faces the baseplate 22. The nozzle plate 23 includes a first surface 23A facing the pressure chambers 32 and a second surface 23B opposite to the first surface 23A.

As shown in FIG. 3, a plurality of integrated nozzles 35 penetrating the nozzle plate 23 is arranged on the nozzle plate 23. The plurality of integrated nozzles 35 is arrayed along the longitudinal direction of the nozzle plate 23.

Figure 5:
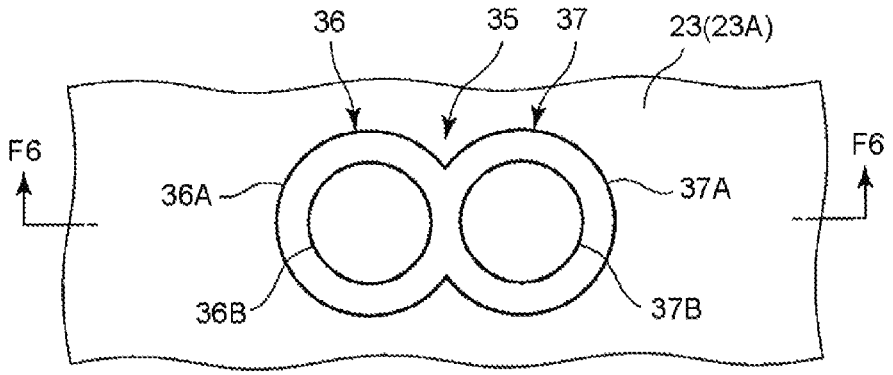
FIG. 5 is a plane view of a nozzle plate of the inkjet head shown in FIG. 1 viewed from a first surface.

As shown in FIG. 3 and FIG. 5, each integrated nozzle 35 includes the first nozzle 36 and the second nozzle 37. For example, the second nozzle 37 is arranged nearby the first nozzle 36 in a manner of being adjacent to the first nozzle 36 in a direction crossing the longitudinal direction of the nozzle plate 23. The first nozzle 36 and the second nozzle 37 are arranged to face the same pressure chamber 32 (refer to FIG. 2).

Figure 6:
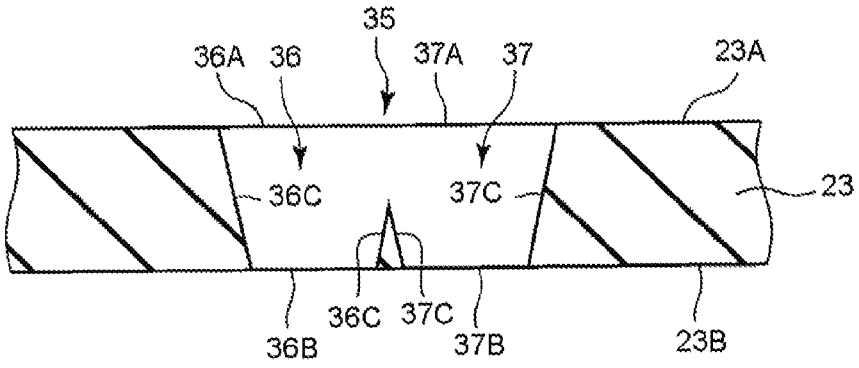
FIG. 6 is a cross-sectional view of the nozzle plate shown in FIG. 5 taken along a line F6-F6.

As shown in FIG. 6, the shapes of the first nozzle 36 and the second nozzle 37 are almost the same. The first nozzle 36 and the second nozzle 37 are formed into, for example, a frustum of which the diameter decreases as it goes closer to the second surface 23B, and the first nozzle 36 and the second nozzle 37 penetrate the first surface 23A and the second surface 23B. The first nozzle 36 includes a first opening section 36A arranged on the first surface 23A and a second opening section 36B arranged on the second surface 23B. The second nozzle 37 includes a third opening section 37A arranged on the first surface 23A and a fourth opening section 37B arranged on the second surface 23B.

As shown in FIG. 5, part of the first opening section 36A is arranged to be overlapped with part of the third opening section 37A. That is, the first opening section 36A is arranged to be connected to the third opening section 37A. Thus, as shown in FIG. 6, the part of the first nozzle 36 on the first surface 23A is integrally connected to the part of the second nozzle 37 on the first surface 23A, and these parts constitute a sharing part.

Figure 7:
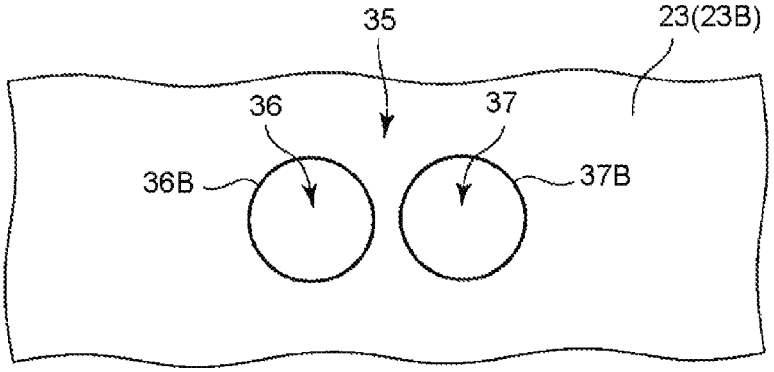
FIG. 7 is a plane view of the nozzle plate shown in FIG. 5 viewed from a second surface.

As shown in FIG. 7, the second opening section 36B, though separated from the fourth opening section 37B, is arranged nearby the fourth opening section 37B. Thus, the part of the first nozzle 36 on the second surface 23B is separated from the part of the second nozzle 37 on the second surface 23B.

As shown in FIG. 6, a first peripheral surface 36C (inner peripheral surface, lateral surface and slope) of the first nozzle 36 extends linearly from the second surface 23B towards the first surface 23A. The first peripheral surface 36C (inner peripheral surface, lateral surface and slope) of the first nozzle 36 intersects, at the way from the second surface 23B towards the first surface 23A, with a second peripheral surface 37C (inner peripheral surface, lateral surface and slope) of the second nozzle 37 which extends linearly from the second surface 23B towards the first surface 23A.

Next, the manufacturing process of the inkjet head 11 having the constitution described above is described.

First, the supply holes 26 and the discharge holes 27 are formed on the baseplate 22 constituted by an unfired ceramic sheet (ceramic green sheet) through press molding processing. Then the baseplate 22 is fired.

After the firing process is completed, as shown in FIG. 3, a pair of blocks 25 of piezoelectric bodies serving as the driving elements is adhered to the mounting surface of the baseplate 22. At this time, the pair of blocks 25 is positioned against the baseplate 22 through a jig and adhered to the baseplate 22.

Next, a so-called tapering processing (chamfering processing) is carried out at the corners of each block 25 adhered to the baseplate 22. In this way, the cross-section of each block 25 is in a trapezoidal shape as shown in FIG. 2. Then a plurality of grooves (pressure chambers 32) and the plate-shaped driving elements 31 are formed on the blocks 25. The plurality of grooves is formed by, for example, a multi-cutter of a dicing saw used for cutting an IC wafer and the like.

Next, the nickel thin film is formed through, for example, electroless plating on the mounting surface of the baseplate 22, the bottoms of the grooves (pressure chambers 32) and the lateral sides of the plate-shaped driving elements 31. The electrodes 34 and the wiring patterns 21 are formed by patterning the nickel thin film through laser irradiation.

Further, the frame member 24 is adhered to the baseplate 22 and then the nozzle plate 23 is adhered to the frame member 24. Then the integrated nozzles 35 (first nozzles 36 and second nozzles 37) are formed by irradiating the nozzle plate 23 with laser. In addition, it is exemplified in the present embodiment that the integrated nozzles 35 are formed on the nozzle plate 23 through laser after the nozzle plate 23 is adhered to the frame member 24; however, the nozzle forming method is not limited to this. It is also applicable that the integrated nozzles 35 are formed on the nozzle plate 23 through pressing process and the like in advance, and then the nozzle plate 23 is adhered to the frame member 24.

At last, the pair of circuit substrates 14 is adhered to the baseplate 22 through an ACF, and in this way, the inkjet head 11 is completed.

Next, the liquid ejecting operation of the inkjet head 11 according to the present embodiment is described. The inkjet head 11 according to the present embodiment is a liquid (ink) circulation type inkjet head 11, and the ink ejected from the tank is supplied to the pressure chamber 32 through the supply holes 26 and the common liquid chamber 33. The ink that is not ejected and used in the pressure chamber 32 is collected to the tank from the discharge holes 27. In this way, in the inkjet head 11 according to the present embodiment, the ink is circulated between the tank and the inkjet head 11.

Figure 8:
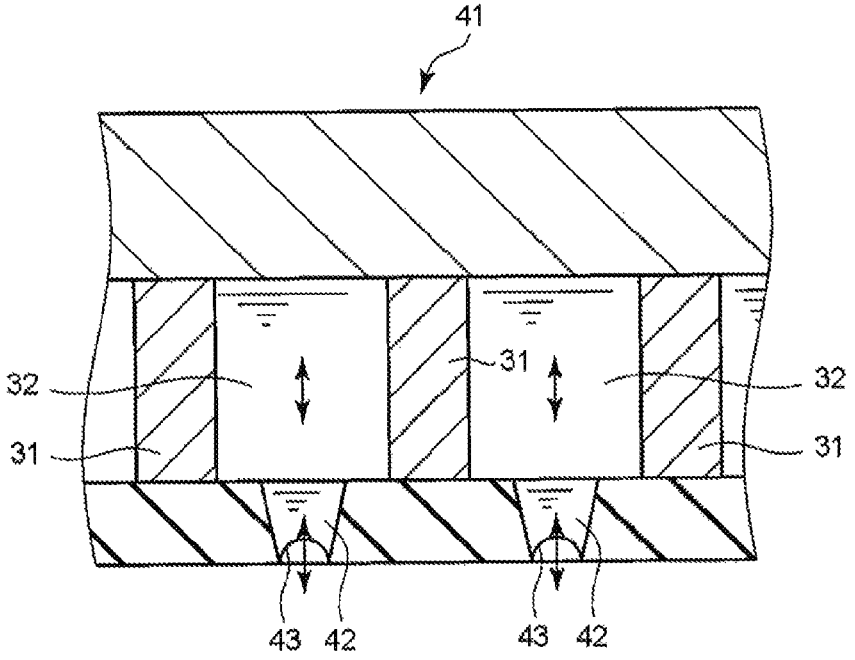
FIG. 8 is a cross-sectional view of a nozzle plate of an inkjet head with a general structure taken along the thickness direction.

Herein, the liquid (ink) ejecting operation is described on the basis of the comparison with an inkjet head 41 (as shown in FIG. 8) in which the first nozzle 36 and the second nozzle 37 are independent and the pressure chamber 32 connected with these nozzles is also independent.

As shown in FIG. 8, in the conventional inkjet head 41, the driving elements 31 are operated to increase or decrease the volume of the pressure chamber 32 when to eject liquid from the nozzle 42. For example, if the volume of the pressure chamber 32 is decreased to a volume smaller than the original volume after being increased temporarily, the liquid in the pressure chamber 32 is pressurized, and droplets are ejected vigorously towards the print target from the nozzles 42. The meniscus surface 43 protrudes outwards immediately before the liquid is ejected and is ejected to the print target as droplets as it is. After the droplets are ejected, the meniscus surface 43 is retracted backwards into the nozzle 42. As stated above, the meniscus surface 43 vibrates in a direction indicated by an arrow under the pressure of the driving element 31 immediately before and after the printing. As a result, the liquid (ink) in the pressure chamber 32 also vibrates in the direction indicated by the arrow. At this time, as the first nozzle 36 and the pressure chamber 32 connected thereto are independent from the second nozzle 37 and the pressure chamber 32 connected thereto, thus, the vibration of the liquid inside the pressure chambers 32 is independent. Thus, difference occurs in the vibration of the liquid (meniscus surface 43) due to the size variation of the first nozzles 36 and the second nozzles 37 and the volume variation of the pressure chambers 32. As a result, a variation in the ejecting performance such as the liquid ejecting speed, liquid ejecting amount and the like is likely to occur between the first nozzle 36 and the second nozzle 37.

Figure 9:
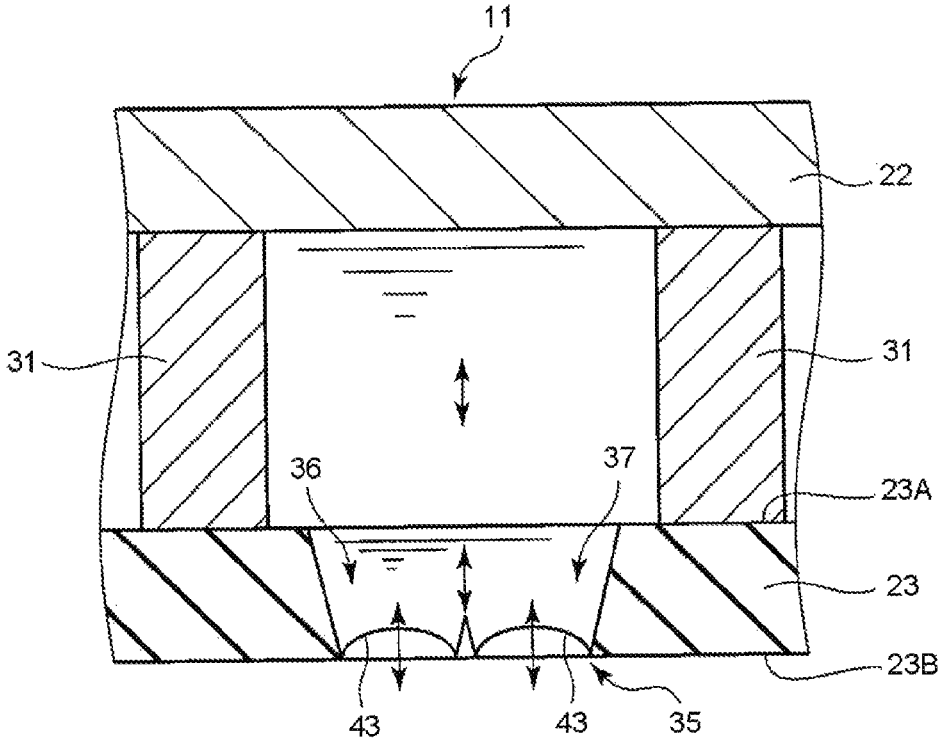
FIG. 9 is a cross-sectional view of the nozzle plate of the inkjet head shown in FIG. 1 taken along the thickness direction.

FIG. 9 is an enlarged diagram illustrating the parts surrounding the first nozzle 36 and the second nozzle 37 of the inkjet head 11 according to the present embodiment.

In the inkjet head 11, the driving elements 31 are driven to increase or decrease the volume of the pressure chamber 32 when to eject liquid from the integrated nozzles 35, similar to that shown in FIG. 8. For example, if the volume of the pressure chamber 32 is decreased to a volume smaller than the original volume after being increased temporarily, the liquid in the pressure chamber 32 is pressurized, and droplets are ejected simultaneously from the first nozzle 36 and the second nozzle 37. The meniscus surfaces 43 of the first nozzle 36 and the second nozzle 37 protrude outwards immediately before the liquid is ejected and are ejected to the print target as droplets as it is. After the droplets are ejected, the meniscus surface 43 of the first nozzle 36 and the meniscus surface 43 of the second nozzle 37 are retracted backwards into the first nozzle 36 and the second nozzle 37. As stated above, the meniscus surface 43 vibrates in a direction indicated by an arrow under the pressure of the driving element 31 immediately before and after the printing. As a result, the liquid in the parts of the first nozzle 36 and the second nozzle 37 nearby the pressure chambers 32 (the first surface 23A side of the nozzle plate 23) and the liquid (ink) in the pressure chamber 32 also vibrate in the direction indicated by the arrow.

In the present embodiment, as the first nozzle 36, the second nozzle 37 and the pressure chambers 32 connected thereto are connected to each other, thus, the vibration of the liquid in these components are synchronous. As a result, it is possible to prevent the occurrence of difference in the vibration of the liquid (the vibration of the meniscus surfaces 43) caused by the size variation of the first nozzle 36 and the second nozzle 37. As a result, it is possible to prevent the occurrence of a variation in the ejecting performance such as the liquid ejecting speed, liquid ejecting amount and the like between the first nozzle 36 and the second nozzle 37.

In accordance with the first embodiment, the inkjet head 11 comprises the pressure chamber 32; the nozzle plate 23 including the first surface 23A at the side of the pressure chamber 32, the second surface 23B opposite to the first surface 23A, the first nozzle 36 formed into a frustum which penetrates the first surface 23A and the second surface 23B and the diameter of which decreases as it goes closer to the second surface 23B, and the second nozzle 37 formed into a frustum which penetrates the first surface 23A and the second surface 23B and the diameter of which decreases as it goes closer to the second surface 23B; and the driving element 31 which is arranged adjacent to the pressure chamber 32 to eject droplets from the first nozzle 36 and the second nozzle 37 simultaneously; wherein the part of the first nozzle 36 on the first surface 23A is integrally connected to the part of the second nozzle 37 on the first surface 23A, and the part of the first nozzle 36 on the second surface 23B is separated from the part of the second nozzle 37 on the second surface 23B.

In accordance with the constitution, the droplets can be ejected from the first nozzle 36 and the second nozzle 37 simultaneously, thus, there can be provided an inkjet head 11 that is capable of ejecting a large amount of droplets through one ejecting driving operation. Further, in accordance with the constitution, the part of the first nozzle 36 on the first surface 23A can be integrally connected to the part of the second nozzle 37 on the first surface 23A. In this way, it is possible to synchronize (share) the vibration of the meniscus surface 43 of the first nozzle 36 and the second nozzle 37, which can reduce the variation in the liquid ejecting performance caused by the size variation of the first nozzles 36 and the second nozzles 37.

The peripheral surface of the first nozzle 36 extends linearly from the second surface 23B towards the first surface 23A and intersects, at the way from the second surface 23B towards the first surface 23A, with the peripheral surface of the second nozzle 37 which extends linearly from the second surface 23B towards the first surface 23A.

In accordance with the constitution, a part connected with the second nozzle 37 can be arranged at the peripheral surface of the first nozzle 36 at the way from the second surface 23B towards the first surface 23A. In this way, it is possible to arrange the part of the first nozzle 36 on the second surface 23B more closer to the part of the second nozzle 37 on the second surface 23B, which can make the synchronization of the vibration of the meniscus surface 43 between the two nozzles much more easier. Thus, it is possible to prevent the occurrence of the variation in the liquid ejecting performance caused by the size variation of the first nozzles 36 and the second nozzles 37.

A Second Embodiment

Hereinafter, the second embodiment of the inkjet head 11 is described with reference to FIG. 10-FIG. 12. The inkjet head 11 described in the present embodiment is the same as that described in the first embodiment except that a sharing part of the first nozzle 36-the fourth nozzle 52 is formed. Thus, the different part is mainly described and the same part is not shown or described repeatedly.

Figure 10:
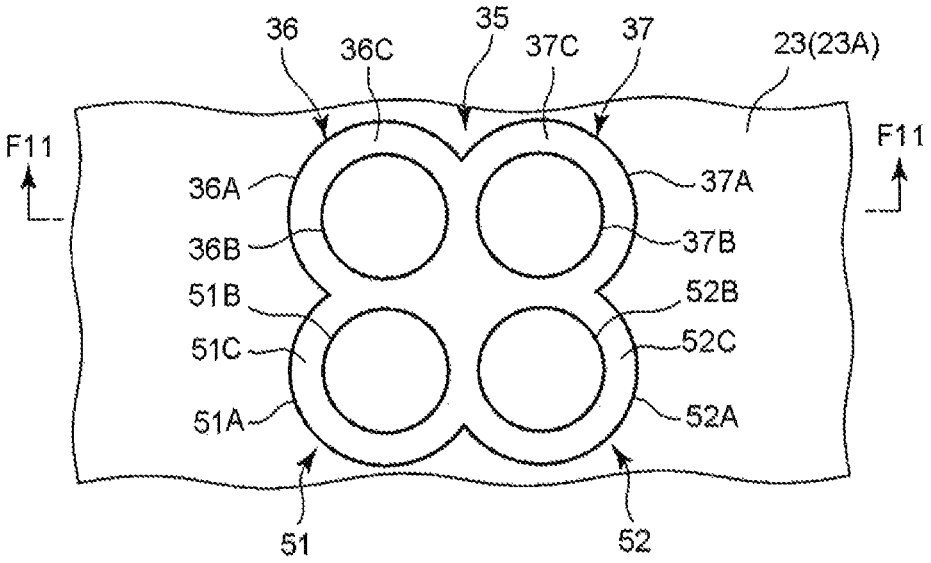
FIG. 10 is a plane view of a nozzle plate of an inkjet head according to a second embodiment viewed from a first surface.

FIG. 10 is a diagram of the nozzle plate 23 viewed from the pressure chamber 32 (first surface 23A). FIG. 11 is a cross-sectional view taken along a line F11-F11 shown in FIG. 10. FIG. 12 is a diagram of the nozzle plate 23 viewed from an outer side (second surface side).

A plurality of integrated nozzles 35 that penetrates the nozzle plate 23 is arranged on the nozzle plate 23. Similar to those shown in FIG. 1, the plurality of integrated nozzles 35 is arranged along the longitudinal direction of the nozzle plate 23.

As shown in FIG. 10, each integrated nozzle 35 includes the first nozzle 36, the second nozzle 37, a third nozzle 51 and a fourth nozzle 52. The second nozzle 37 is arranged nearby the first nozzle 36 and is adjacent to the first nozzle 36 in, for example, a direction crossing the longitudinal direction of the nozzle plate 23. The third nozzle 51 is arranged nearby the first nozzle 36 and is adjacent to the first nozzle 36 in, for example, the longitudinal direction of the nozzle plate 23. The fourth nozzle 52 is arranged nearby the second nozzle 37 and is adjacent to the second nozzle 37 in, for example, the longitudinal direction of the nozzle plate 23. As shown in FIG. 12, the first nozzle 36 is in diagonal to the fourth nozzle 52, and the second nozzle 37 is in diagonal to the third nozzle 51. The first nozzle 36-fourth nozzle 52 are arranged to face the same pressure chamber 32.

Figure 11:
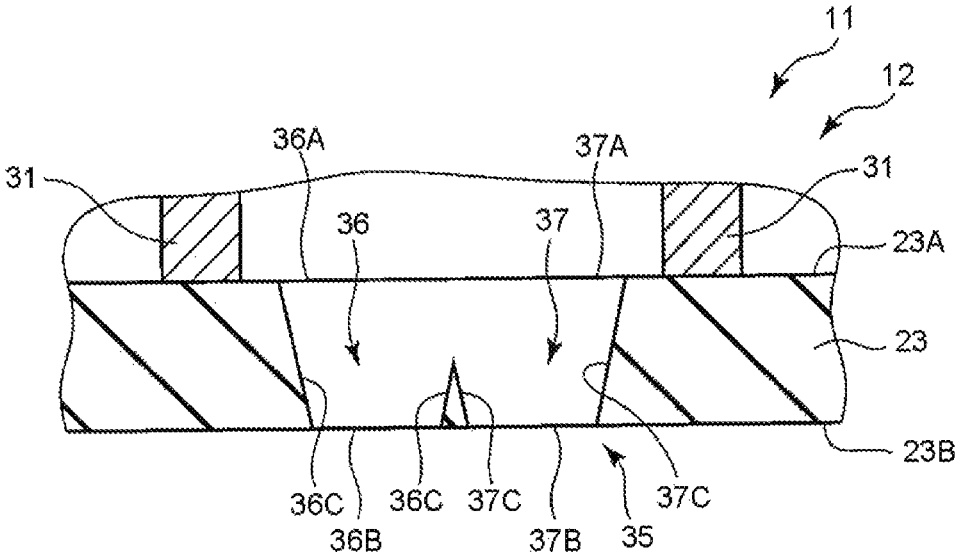
FIG. 11 is a cross-sectional view of the nozzle plate shown in FIG. 10 taken along a line F11-F11.

As shown in FIG. 11, the shapes of the first nozzle 36-fourth nozzle 52 are almost the same. The first nozzle 36-fourth nozzle 52 are formed into a frustum which penetrates the first surface 23A and the second surface 23B and the diameter of which decreases as it goes closer to the second surface 23B. The first nozzle 36 includes the first opening section 36A arranged on the first surface 23A and the second opening section 36B arranged on the second surface 23B. The second nozzle 37 includes the third opening section 37A arranged on the first surface 23A and the fourth opening section 37B arranged on the second surface 23B.

Figure 12:
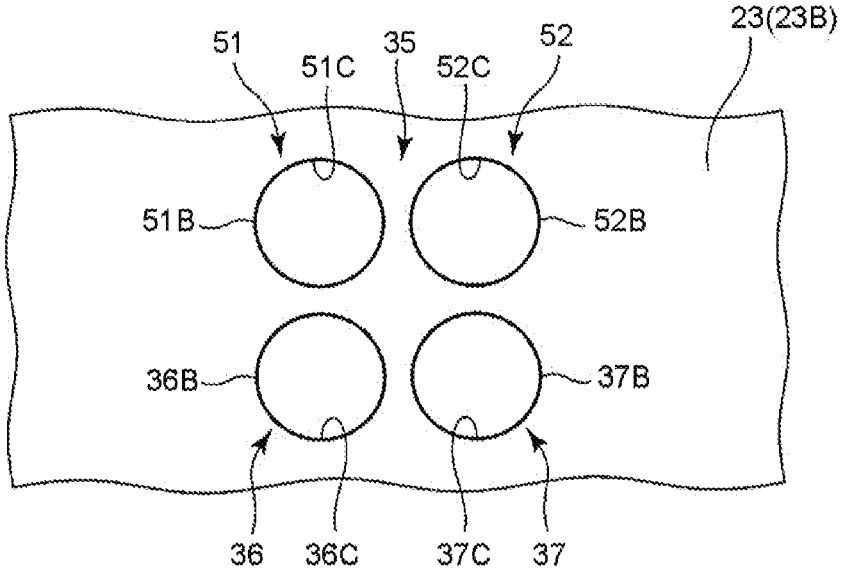
FIG. 12 is a plane view of the nozzle plate shown in FIG. 10 viewed from a second surface.

As shown in FIG. 10 and FIG. 12, the third nozzle 51 includes a fifth opening section 51A arranged on the first surface 23A and a sixth opening section 51B arranged on the second surface 23B. The fourth nozzle 52 includes a seventh opening section 52A arranged on the first surface 23A and an eighth opening section 52B arranged on the second surface 23B.

As shown in FIG. 10, part of the first opening section 36A is arranged in a manner of being overlapped with part of the third opening section 37A and the fifth opening section 51A. Thus, the first opening section 36A is connected to the third opening section 37A and the fifth opening section 51A. Similarly, part of the seventh opening section 52A is arranged in a manner of being overlapped with part of the third opening section 37A and the fifth opening section 51A. Thus, the seventh opening section 52A is connected to the third opening section 37A and the fifth opening section 51A.

Thus, in the present embodiment, the parts of the first nozzle 36-fourth nozzle 52 on the first surface 23A constitute the sharing part, that is, are integrally arranged.

As shown in FIG. 12, the second opening section 36B, though separated from the fourth opening section 37B and the sixth opening section 51B, is arranged nearby the fourth opening section 37B and the sixth opening section 51B. Similarly, the eighth opening section 52B, though separated from the fourth opening section 37B and the sixth opening section 51B, is arranged nearby the fourth opening section 37B and the sixth opening section 51B. Thus, the parts of the first nozzle 36-fourth nozzle 52 on the second surface 23B are separated from each other to constitute independent parts.

As shown in FIG. 11, the first peripheral surface 36C (inner peripheral surface, lateral surface and slope) of the first nozzle 36 extends linearly from the second surface 23B towards the first surface 23A. The first peripheral surface 36C of the first nozzle 36 intersects, at the way from the second surface 23B towards the first surface 23A, with the second peripheral surface 37C (inner peripheral surface, lateral surface and slope) of the second nozzle 37 which extends linearly from the second surface 23B towards the first surface 23A. Similarly, as shown in FIG. 10 and FIG. 12, the first peripheral surface 36C (inner peripheral surface, lateral surface and slope) of the first nozzle 36 intersects, at the way from the second surface 23B towards the first surface 23A, with a third peripheral surface 51C (inner peripheral surface, lateral surface and slope) of the third nozzle 51 which extends linearly from the second surface 23B towards the first surface 23A.

Further, a fourth peripheral surface 52C (inner peripheral surface, lateral surface and slope) of the fourth nozzle 52 extends linearly from the second surface 23B towards the first surface 23A. The fourth peripheral surface 52C of the fourth nozzle 52 intersects, at the way from the second surface 23B towards the first surface 23A, with the second peripheral surface 37C of the second nozzle 37 and the third peripheral surface 510 of the third nozzle 51.

In the present embodiment, a pair of driving elements 31 between which the pressure chamber 32 is nipped can eject droplets from the first nozzle 36, the second nozzle 37, the third nozzle 51 and the fourth nozzle 52 simultaneously.

The manufacturing process of the inkjet head 11 according to the present embodiment is almost the same as that described in the first embodiment except that the number of the nozzles formed as the integrated nozzle 35 is different from that in the first embodiment.

In the present embodiment, the number of the nozzles included in the integrated nozzle 35 is different from that in the first embodiment, thus, the amount of the droplets (ink drops) that can be ejected by the inkjet head 11 according to the present embodiment through one ejecting driving operation is different from that of the inkjet head 11 described in the first embodiment. That is, the inkjet head 11 according to the present embodiment can eject twice as much droplets (ink drops) as the inkjet head 11 in the first embodiment. The other parts of the present embodiment have the same functions as those of the first embodiment.

In accordance with the present embodiment, the inkjet head 11 includes the pressure chamber 32; the nozzle plate 23 including the first surface 23A at the side of the pressure chamber 32, the second surface 23B opposite to the first surface 23A, the first nozzle 36 formed into a frustum which penetrates the first surface 23A and the second surface 23B and the diameter of which decreases as it goes closer to the second surface 23B, the second nozzle 37 formed into a frustum which penetrates the first surface 23A and the second surface 23B and the diameter of which decreases as it goes closer to the second surface 23B, the third nozzle 51 formed into a frustum which penetrates the first surface 23A and the second surface 23B and the diameter of which decreases as it goes closer to the second surface 23B, and the fourth nozzle 52 formed into a frustum which penetrates the first surface 23A and the second surface 23B and the diameter of which decreases as it goes closer to the second surface 23B; and the driving element 31 which is arranged adjacent to the pressure chamber 32 to eject droplets from the first nozzle 36, the second nozzle 37, the third nozzle 51 and the fourth nozzle 52 simultaneously; wherein the parts of the first nozzle 36-fourth nozzle 52 on the first surface 23A are integrally connected to each other, and the parts of the first nozzle 36-fourth nozzle 52 on the second surface 23B are separated from each other.

In accordance with the constitution, the droplets can be ejected from the first nozzle 36-fourth nozzle 52 simultaneously, thus, there can be provided an inkjet head 11 that is capable of ejecting a large amount of droplets through one ejecting driving operation. Further, in accordance with the constitution, there can be provided an inkjet head 11 in which the ejecting performance of the first nozzle 36-fourth nozzle 52 is uniform.

A Third Embodiment

Hereinafter, the third embodiment of the inkjet head 11 is described with reference to FIG. 13-FIG. 15. Though the inkjet head 11 according to the present embodiment is the same as that described in the second embodiment in the point that the sharing part is formed at a certain position at the first surface 23A of the first nozzle 36-fourth nozzle 52, the shape of the sharing part is different from that in the second embodiment. However, other parts of the third embodiment are the same as those of the second embodiment. Thus, the different part is mainly described and the same part is not shown or described repeatedly.

Figure 13:
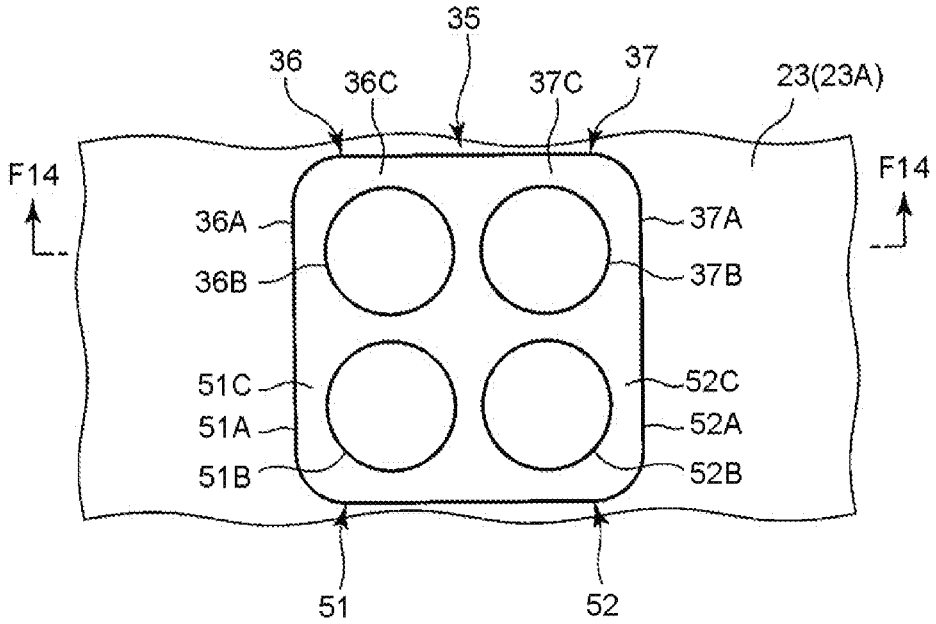
FIG. 13 is a plane view of a nozzle plate of an inkjet head according to a third embodiment viewed from a first surface.

FIG. 13 is a diagram of the nozzle plate 23 viewed from the pressure chamber 32 (first surface 23A). FIG. 14 is a cross-sectional view taken along a line F14-F14 shown in FIG. 13. FIG. 15 is a diagram of the nozzle plate 23 viewed from an outer side (second surface side).

A plurality of integrated nozzles 35 that penetrates the nozzle plate 23 is arranged on the nozzle plate 23. Similar to those shown in FIG. 1, the plurality of integrated nozzles 35 is arranged along the longitudinal direction of the nozzle plate 23 at specific intervals. Each integrated nozzle 35 includes the first nozzle 36, the second nozzle 37, a third nozzle 51 and a fourth nozzle 52. The second nozzle. 37 is arranged nearby the first nozzle 36 and is adjacent to the first nozzle 36 in, for example, a direction crossing the longitudinal direction of the nozzle plate 23. The third nozzle 51 is arranged nearby the first nozzle 36 and is adjacent to the first nozzle 36 in, for example, the longitudinal direction of the nozzle plate 23. The fourth nozzle 52 is arranged nearby the second nozzle 37 and is adjacent to the second nozzle 37 in, for example, the longitudinal direction of the nozzle plate 23. As shown in FIG. 15, the first nozzle 36 is in diagonal to the fourth nozzle 52, and the second nozzle 37 is in diagonal to the third nozzle 51. The first nozzle 36-fourth nozzle 52 are arranged to face the same pressure chamber 32.

The shapes of the first nozzle 36-fourth nozzle 52 are almost the same. That is, each of the first nozzle 36-fourth nozzle 52 is formed into, for example, a frustum. The first nozzle 36 includes the first opening section 36A arranged on the first surface 23A and the second opening section 36B arranged on the second surface 23B. The second nozzle 37 includes the third opening section 37A arranged on the first surface 23A and the fourth opening section 37B arranged on the second surface 23B. The third nozzle 51 includes the fifth opening section 51A arranged on the first surface 23A and the sixth opening section 51B arranged on the second surface 23B. The fourth nozzle 52 includes the seventh opening section 52A arranged on the first surface 23A and the eighth opening section 52B arranged on the second surface 23B.

In the present embodiment, the first opening section 36A-seventh opening section 52A constitute an integrated substantially-square sharing opening section. Thus, in the present embodiment, the parts of the first nozzle 36-fourth nozzle 52 on the first surface 23A constitute a substantially quadrangular sharing part, that is, are integrally arranged.

Figure 15:
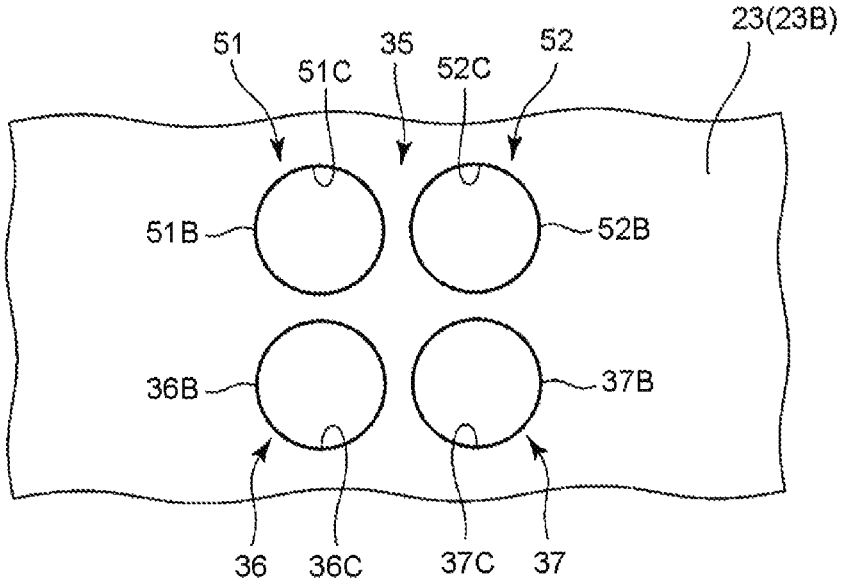
FIG. 15 is a plane view of the nozzle plate shown in FIG. 13 viewed from a second surface.

As shown in FIG. 15, the second opening section 36B, though separated from the fourth opening section 37B and the sixth opening section 51B, is arranged nearby the fourth opening section 37B and the sixth opening section 51B. Similarly, the eighth opening section 52B, though separated from the fourth opening section 37B and the sixth opening section 51B, is arranged nearby the fourth opening section 37B and the sixth opening section 51B. Thus, the parts of the first nozzle 36-fourth nozzle 52 on the second surface 23B are separated from each other to constitute independent parts.

Figure 14:
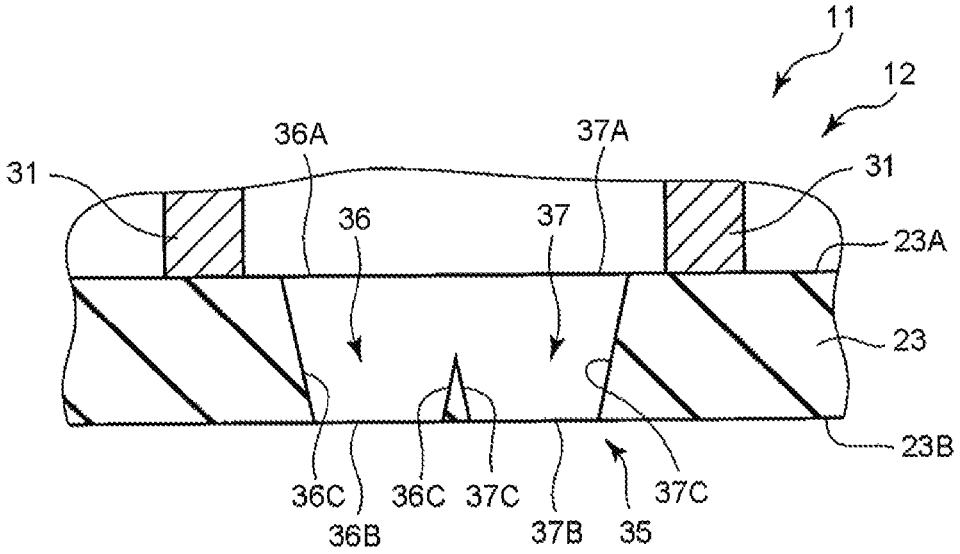
FIG. 14 is a cross-sectional view of the nozzle plate shown in FIG. 13 taken along a line F14-F14.

As shown in FIG. 14, the first peripheral surface 36C (inner peripheral surface, lateral surface and slope) of the first nozzle 36 extends linearly from the second surface 23B towards the first surface 23A. The first peripheral surface 36C of the first nozzle 36 intersects, at the way from the second surface 23B towards the first surface 23A, with the second peripheral surface 37C (inner peripheral surface, lateral surface and slope) of the second nozzle 37 which extends linearly from the second surface 23B towards the first surface 23A. Similarly, as shown in FIG. 13 and FIG. 15, the first peripheral surface 36C (inner peripheral surface, lateral surface and slope) of the first nozzle 36 intersects, at the way from the second surface 23B towards the first surface 23A, with a third peripheral surface 51C (inner peripheral surface, lateral surface and slope) of the third nozzle 51 which extends linearly from the second surface 23B towards the first surface 23A.

Further, the fourth peripheral surface 52C (inner peripheral surface, lateral surface and slope) of the fourth nozzle 52 extends linearly from the second surface 23B towards the first surface 23A. The fourth peripheral surface 52C of the fourth nozzle 52 intersects, at the way from the second surface 23B towards the first surface 23A, with the second peripheral surface 37C of the second nozzle 37 and the third peripheral surface 51C of the third nozzle 51.

In the present embodiment, a pair of driving elements 31 between which the pressure chamber 32 is nipped can eject droplets from the first nozzle 36, the second nozzle 37, the third nozzle 51 and the fourth nozzle 52 simultaneously.

The manufacturing process of the inkjet head 11 according to the present embodiment is almost the same as that described in the second embodiment. In the present embodiment, in the forming process of the integrated nozzle 35, the parts of the first nozzle 36-fourth nozzle 52 on the first surface 23A are formed as a substantially-square sharing opening section. The integrated nozzle 35 may be formed through laser processing or pressing processing. In the present embodiment, the inkjet head 11 has almost the same functions as those in the second embodiment.

In accordance with the present embodiment, the droplets can be ejected from the first nozzle 36-fourth nozzle 52 simultaneously, thus, there can be provided an inkjet head 11 that is capable of ejecting a large amount of droplets through one ejecting driving operation. Further, in accordance with the constitution, there can be provided an inkjet head 11 in which the ejecting performance of the first nozzle 36-fourth nozzle 52 is uniform.

The first-third embodiments are described above, however, the components in these embodiments may be appropriately combined.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid circulation type inkjet head comprising:

a plurality of pressure chambers; and a nozzle plate configured to include a first surface at a side of the pressure chambers and a second surface opposite to the first surface, the nozzle plate comprising a plurality of integrated nozzles, wherein the plurality of integrated nozzles are formed into a frustum which penetrates the first surface and the second surface, the plurality of integrated nozzles are arrayed along the nozzle plate in a longitudinal direction of the nozzle plate, each of the plurality of integrated nozzles comprises a first nozzle and a second nozzle, the diameters of the first nozzle and the diameter of the second nozzle decrease as they get closer to the second surface, an edge of an opening of the first nozzle on the first surface is integrally connected to an edge of an opening of the second nozzle on the first surface, an edge of an opening of the first nozzle on the second surface is separated from an edge of an opening of the second nozzle on the second surface, a portion of the nozzle plate which separates the first nozzle from the second nozzle at the second surface forms a triangular shape extending from the second surface towards the first surface, a peripheral surface of the first nozzle extends linearly from the second surface towards the first surface and intersects, at a way from the second surface towards the first surface, with a peripheral surface of the second nozzle which extends linearly from the second surface towards the first surface, and a point of the portion of the nozzle plate which is furthest from the second surface does not reach the first surface.

2. The liquid circulation type inkjet head according to claim 1, wherein the first nozzle and the second nozzle are adjacently arranged in a direction crossing the longitudinal direction of the nozzle plate.

3. The liquid circulation type inkjet head according to claim 2, wherein the first nozzle and the second nozzle are adjacently arranged in a direction orthogonal to the longitudinal direction of the nozzle plate.

4. The liquid circulation type inkjet head according to claim 2, wherein the plurality of integrated nozzles further comprises a third nozzle adjacent to the first nozzle in the longitudinal direction of the nozzle plate and a fourth nozzle adjacent to the second nozzle in the longitudinal direction of the nozzle plate, wherein the third nozzle and the fourth nozzle are arranged to face the same pressure chamber which the first nozzle and the second nozzle face.

5. The liquid circulation type inkjet head according to claim 1, wherein the first nozzle and the second nozzle are identical in shape.

6. An inkjet printer comprising:

a liquid circulation type inkjet head; and a tank connected with the liquid circulation type inkjet head, the liquid circulation type inkjet head comprising:

a plurality of pressure chambers; and a nozzle plate configured to include a first surface at a side of the pressure chambers and a second surface opposite to the first surface, the nozzle plate comprising a plurality of integrated nozzles, wherein the plurality of integrated nozzles are formed into a frustum which penetrates the first surface and the second surface, the plurality of integrated nozzles are arrayed along the nozzle plate in a longitudinal direction of the nozzle plate, each of the plurality of integrated nozzles comprises a first nozzle and a second nozzle, the diameters of the first nozzle and the diameter of the second nozzle decrease as they get closer to the second surface, an edge of an opening of the first nozzle on the first surface is integrally connected to an edge of an opening of the second nozzle on the first surface, an edge of an opening of the first nozzle on the second surface is separated from an edge of an opening of the second nozzle on the second surface, a portion of the nozzle plate which separates the first nozzle from the second nozzle at the second surface forms a triangular shape extending from the second surface towards the first surface, a peripheral surface of the first nozzle extends linearly from the second surface towards the first surface and intersects, at the way from the second surface towards the first surface, with a peripheral surface of the second nozzle which extends linearly from the second surface towards the first surface, and a point of the portion of the nozzle plate which is furthest from the second surface does not reach the first surface.

7. The inkjet printer according to claim 6, wherein the first nozzle and the second nozzle are adjacently arranged in a direction crossing the longitudinal direction of the nozzle plate.

8. The inkjet printer according to claim 7, wherein the first nozzle and the second nozzle are adjacently arranged in a direction orthogonal to the longitudinal direction of the nozzle plate.

9. The inkjet printer according to claim 7, wherein the plurality of integrated nozzles further comprises a third nozzle adjacent to the first nozzle in the longitudinal direction of the nozzle plate and a fourth nozzle adjacent to the second nozzle in the longitudinal direction of the nozzle plate, wherein the third nozzle and the fourth nozzle are arranged to face the same pressure chamber which the first nozzle and the second nozzle face.

10. The inkjet printer according to claim 6, wherein the first nozzle and the second nozzle are identical in shape.

* * * * *